US007182078B2

(12) United States Patent
Ameloot et al.

(10) Patent No.: US 7,182,078 B2
(45) Date of Patent: Feb. 27, 2007

(54) SYSTEM FOR ASSISTING REGENERATING DEPOLLUTION MEANS INTEGRATED IN AN EXHAUST SYSTEM OF AN ENGINE

(75) Inventors: Piet Ameloot, Neuilly sur Seine (FR); Pascal Folliot, Guyancourt (FR)

(73) Assignee: Peugeot Citroen Automobiles SA, Velizy-Villacoublay (FR)

( * ) Notice: Subject to any disclaimer, the term of this patent is extended or adjusted under 35 U.S.C. 154(b) by 0 days.

(21) Appl. No.: 11/045,047

(22) Filed: Jan. 31, 2005

(65) Prior Publication Data

US 2005/0166903 A1 Aug. 4, 2005

(30) Foreign Application Priority Data

Feb. 3, 2004 (FR) ..... 04 01012

(51) Int. Cl.
*F02D 41/14* (2006.01)
*F02D 41/00* (2006.01)

(52) U.S. Cl. ..... 123/703; 60/295

(58) Field of Classification Search ..... 123/672, 123/679, 703, 299, 300, 305, 430; 60/295, 60/285, 274
See application file for complete search history.

(56) References Cited

U.S. PATENT DOCUMENTS 5,771,685 A * 6/1998 Hepburn ..... 60/274
6,293,092 B1 * 9/2001 Ament et al. ..... 60/274
6,637,197 B1 * 10/2003 Stahl ..... 60/295
2004/0159097 A1 * 8/2004 Uematsu et al. ..... 60/286
2005/0022516 A1 * 2/2005 Miura ..... 60/295
2005/0050879 A1 * 3/2005 Sun et al. ..... 60/277

FOREIGN PATENT DOCUMENTS

| | | |
|---|---|---|
| EP | 0 982 487 | 3/2000 |
| EP | 1 028 243 | 8/2000 |
| EP | 1 193 383 | 4/2002 |
| EP | 1 245 817 | 10/2002 |
| EP | 1 302 647 | 4/2003 |

* cited by examiner

*Primary Examiner*—Mahmoud Gimie
(74) *Attorney, Agent, or Firm*—Nicholas E. Seckel

(57) ABSTRACT

A system for assisting regeneration of depollution included in an exhaust system of a motor vehicle engine by switching the engine between operation in lean mode and operation in rich mode, depending on various parameters for controlling the operation of the engine, which includes a lambda probe placed in the exhaust gas outlet from the engine, and which corrects at least one of the operating parameters of the engine in order to provide closed-loop regulation of the richness of the exhaust gas about a target value while the engine is operating in rich mode.

5 Claims, 1 Drawing Sheet

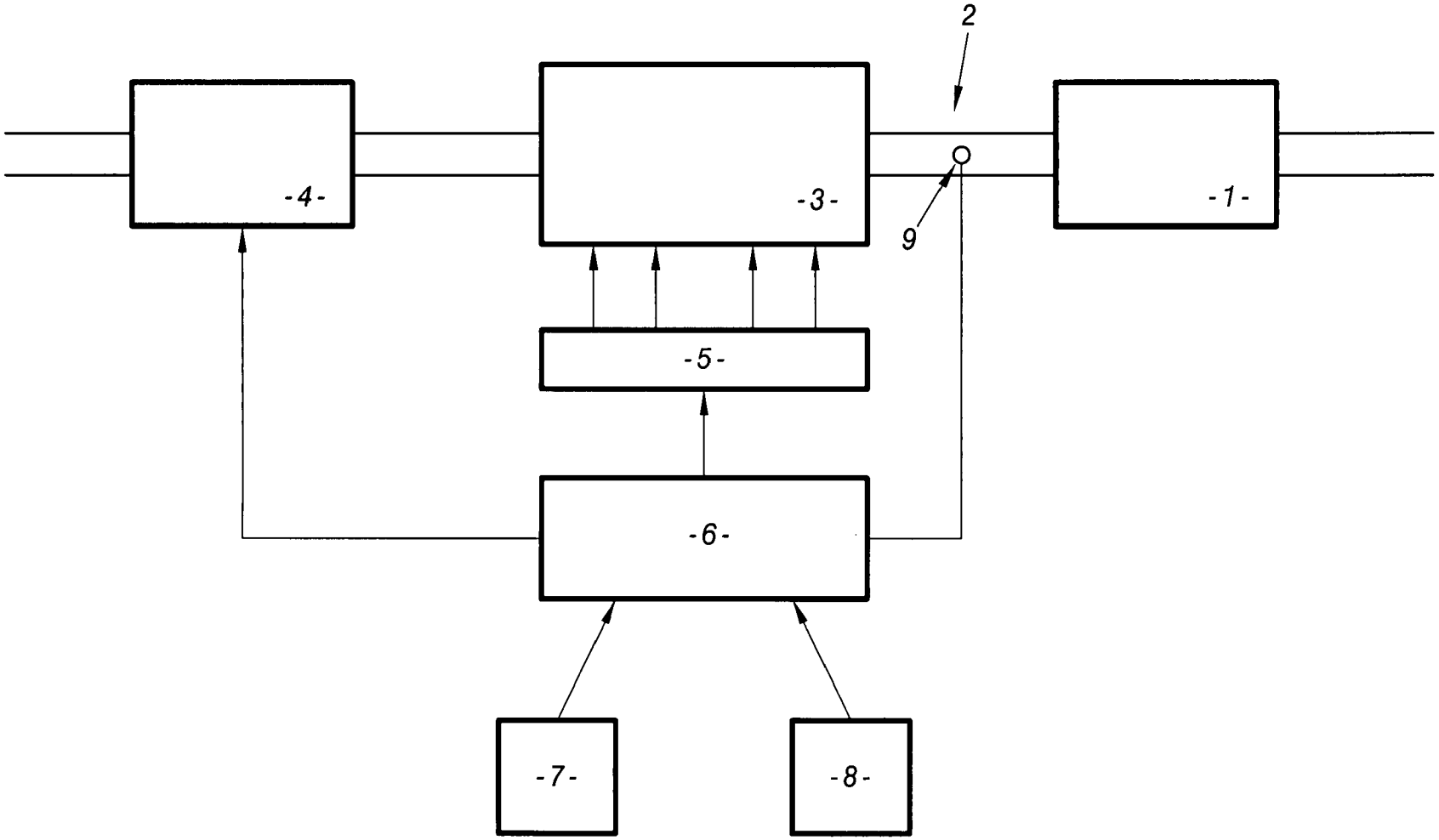
-1-
2
9
-3-
-5-
-6-
-8-
-7-
-4-

SYSTEM FOR ASSISTING REGENERATING DEPOLLUTION MEANS INTEGRATED IN AN EXHAUST SYSTEM OF AN ENGINE

BACKGROUND OF THE INVENTION

The present invention relates to a system for assisting in regenerating depollution means integrated in an exhaust system of an engine for a motor vehicle.

For example, it is known that such depollution means may include a NOx trap, i.e. a system for reducing polluting emissions from motor vehicle engines.

The engine is then associated with means for monitoring its operation to cause its operation to switch between standard operation in lean mode and regenerating operation in rich mode, depending on various parameters for monitoring the operation of the engine.

In standard operation in lean mode, the NOx trap stocks NOx, and once the trap becomes saturated, trap regeneration is triggered by switching the engine to operate in a rich mode of operation for destocking purposes, during which the engine produces reducing agents such as CO and HC, for example.

This is performed in conventional manner by modifying at least one parameter for controlling the operation of the engine, i.e. at least one parameter relating to the injection of fuel into the engine (quantity, phase position, pressure, etc. . . . ) and/or at least one parameter in the air feed loop of the engine (air flow rate, recycling, turbocompressor pressure, etc. . . . ).

The various adjustments of these parameters enable predetermined objectives to be reached in terms of delivered torque, pollution emissions, noise, etc. . . . .

Unfortunately, in this mode of operation, it is necessary to find a compromise between regenerating the NOx trap and oxidizing the reducing agents HC and CO as completely as possible.

SUMMARY OF THE INVENTION

The object of the invention is thus to propose a system which enables these problems to be solved.

To this end, the invention provides a system for assisting regeneration of depollution means included in an exhaust system of a motor vehicle engine by switching the engine between operation in lean mode and operation in rich mode, depending on various parameters for controlling the operation of the engine, the system being characterized in that it comprises a lambda probe placed in the exhaust gas outlet from the engine, and means for correcting at least one of the operating parameters of the engine in order to provide closed-loop regulation of the richness of said exhaust gas about a target value while the engine is operating in rich mode.

According to other characteristics:

- the corrected parameter is the quantity of fuel injected into the engine;
- the corrected parameter is the quantity of fuel injected into the engine during the last injection in a series of fuel injections;
- the corrected parameter is the feed pressure of fuel in a common feed manifold system associated with the engine, with fuel injection durations being kept constant; and
- the corrected parameter is the rate at which air is fed to the engine.

BRIEF DESCRIPTION OF THE DRAWINGS

The invention will be better understood on reading the following description given purely by way of example and made with reference to the accompanying drawing which is a block diagram showing the structure and the operation of a system of the invention.

DETAILED DESCRIPTION OF PARTICULAR EMBODIMENTS

The figure shows a system for assisting regeneration of depollution means, given overall reference 1 in this figure, e.g. integrated in an exhaust system 2 of a motor vehicle engine 3.

The engine is also associated with air feed means given overall reference 4, and with means for controlling its supply of fuel, given overall reference 5, e.g. comprising a common manifold feeding fuel injectors for injecting fuel into the cylinders of the engine.

The operation of these means is governed by control means given overall reference 6.

By way of example, the depollution means comprise a NOx trap and the control means 6 are adapted to cause the operation of the engine to switch between operation in a standard lean mode, and operation in a rich mode for regeneration, depending on various parameters for controlling the operation of the engine.

By way of example, these parameters are represented by references 7 and 8 in this figure.

The parameters 7 are then used for governing the engine operating in lean mode, while the parameters 8 are used for causing the engine to operate in the rich mode for regeneration.

According to the invention, the system also comprises a lambda probe λ given overall reference 9 in the figure, placed beside the exhaust gas outlet from the vehicle engine 3, in order to measure the richness of the engine exhaust gas.

This probe is connected to the control means 6 for correcting at least one parameter for controlling the operation of the engine in order to provide closed-loop regulation of said richness of the exhaust gas on a target value while the engine is operating in rich mode.

In order to obtain a good compromise between regenerating the NOx trap and oxidizing the reducing agents HC and CO at the outlet from the NOx trap to as complete an extent as possible, it is necessary for richness at this level to be controlled accurately.

By providing a control loop based on measured richness, it is possible to achieve this degree of accuracy.

By way of example, the engine operation control parameter that is corrected may be the quantity of fuel injected into the engine or the pressure at which the fuel is injected, or indeed the rate at which air is fed to the engine.

Thus, for example, it is known that present-day engines are fitted with common manifolds for feeding fuel to the cylinders of the engine.

The parameter that is corrected for the purpose of servo-controlling exhaust gas richness can then be the injection pressure used in the manifold.

Under such circumstances, the injection durations are kept constant, thus enabling the total quantity of fuel injected into the cylinders to be adapted, thereby servo-controlling richness.

It is also known that such feed systems perform multiple injections of fuel into the cylinders in a series of injections.

Another way of servo-controlling richness consists in acting on the quantity of fuel injected during one of these injections, and in particular during the last injection in the series, so as to avoid excessively disturbing the operation of the engine in terms of torque, noise, etc.

The last injection is in general at a position lying in the range 10° to 120° after top dead center (TDC).

Yet another way of servo-controlling richness is to act on the rate at which air is fed to the engine by the means 4.

Depending on which parameter is corrected, the governor means 6 are adapted to act on the fuel feed means, or on the engine's air feed loop, in order to servo-control the richness on a target value, and thus obtain the above-mentioned compromise.

The invention claimed is:

1. A system for assisting regeneration of depollution means included in an exhaust system of a motor vehicle engine by switching the engine between operation in lean mode and operation in rich mode, depending on various parameters for controlling the operation of the engine, wherein the system comprises a lambda probe placed in the exhaust gas outlet from the engine upstream from the depollution means, and means for correcting at least one of the operating parameters of the engine as a function of a signal received from the lambda probe, which provides closed-loop regulation of the richness of said exhaust gas about a target value while the engine is operating in rich mode.

2. A system according to claim 1, wherein the corrected parameter is the quantity of fuel injected into the engine.

3. A system according to claim 2, wherein the corrected parameter is the quantity of fuel injected into the engine during the last injection in a series of fuel injections.

4. A system according to claim 1, wherein the corrected parameter is the feed pressure of fuel in a common feed manifold system associated with the engine, with fuel injection durations being kept constant.

5. A system according to claim 1, wherein the corrected parameter is the rate at which air is fed to the engine.

* * * * *